United States Patent [19]

Hausenblas

[11] 4,165,057

[45] Aug. 21, 1979

[54] METHOD OF IMPROVING THE GUIDING OF REACTION DRIVEN FLYING BODIES FOR GROUND-TO-GROUND EMPLOYMENT

[75] Inventor: Helmut Hausenblas, Kassel, Fed. Rep. of Germany

[73] Assignee: Thyssen Industrie Aktiengesellschaft, Essen, Fed. Rep. of Germany

[21] Appl. No.: 733,072

[22] Filed: Oct. 18, 1976

[30] Foreign Application Priority Data

Oct. 17, 1975 [DE] Fed. Rep. of Germany ..... 2546592

[51] Int. Cl.[2] ..... F41G 7/14; F42B 15/02; F41B 9/00

[52] U.S. Cl. ..... 244/3.12; 244/3.16

[58] Field of Search ..... 244/3.12, 3.16

[56] References Cited

U.S. PATENT DOCUMENTS

| | | | |
|---|---|---|---|
| 3,366,346 | 1/1968 | McKnight et al. | 244/3.12 |
| 3,711,046 | 1/1973 | Barhydt et al. | 244/3.12 |
| 3,753,537 | 8/1973 | Karpa et al. | 244/3.12 |

*Primary Examiner*—David H. Brown

*Assistant Examiner*—Thomas H. Webb

*Attorney, Agent, or Firm*—Becker & Becker

[57] ABSTRACT

A method of improving the guiding of reaction driven flying bodies for ground-to-ground utilization and a device for practicing the method in which the distance between a target point and a launching point is determined, as by observation, and a flying body such as a rocket is launched from the launching point while the flight thereof is controlled in conformity with the position of the flying body which latter is determined by detecting radiation given off by the reaction drive of the body. The path of the flying body is controlled so that, upon launching the body from the launching point, the path of the body diverges upwardly from a line joining the launching point and target point and then converges with the line and then follows the line to the target point. The flying body has a steering or guiding mechanism therein to which signals are supplied by a wire leading from a computer that receives a signal corresponding to the target distance and a signal corresponding to the position of the flying body while a timer starts running at the instant of launching of the flying body controls the operation of the computer.

5 Claims, 2 Drawing Figures

Figure 1:
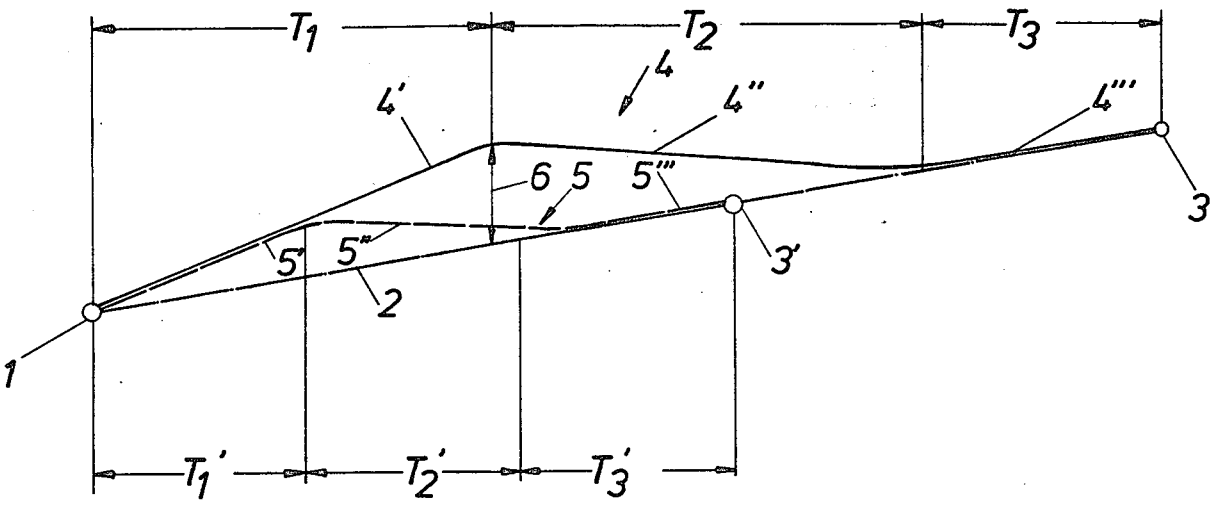

METHOD OF IMPROVING THE GUIDING OF REACTION DRIVEN FLYING BODIES FOR GROUND-TO-GROUND EMPLOYMENT

The present invention relates to a method of improving the guiding of reaction driven flying bodies for the ground-to-ground employment during the approach to the target, while the flying body through the intervention of a remote control wire receives guiding signals from a control station with an optical aiming device and with a device for taking a bearing for the flying body, said last mentioned device being rigidly connected to said optical aiming device. The invention furthermore comprises a device for practicing said method.

Remote control reaction driven flying bodies for ground-to-ground employment, for instance for fighting armored vehicles, have a light source at their stern by means of which during their approach to the target, their respective location and their deviation from the desired trajectory can be ascertained. Remote controlled reaction driven flying bodies of this type comprise a wire connection to the control station for guiding the flying body in target direction, said control station being located at the starting station. The started flying bodies are preferably guided in conformity with the line of sight system while the optical axis of the aiming device is continuously directed toward the aim, and while the flying body by guiding signals is corrected as to its trajectory (German periodical "Soldat und Technik" 1973, issue 12, page 670). With remote controlled reaction driven flying bodies, the guiding shooter or soldier (Lenkschütze) with his telescopic sight follows the target to be hit and simultaneously directs the flying body relative to the line of sight. By actuating a control stick, steering signals emanating from a control device are as to side and height transmitted by the steering wire to the flying body which latter only during the approach to the target is guided above the line of sight and only shortly ahead of the target is deviated toward the line of sight.

In view of these necessary steps, the guiding soldier has to meet high requirements because he has simultaneously to watch two subjects, namely the target which generally is in movement, and the remote controlled guided body.

In order to facilitate this operation and to enable the aiming soldier to concentrate only upon the watching of the target, it is known automatically to effect the guiding of the flying body by the fact that in or on the sight head of the steering periscope there is arranged an infrared goniometer which always with the steering periscope looks into the same direction. The said infrared goniometer measures the respective location of the flying body by means of the light source relative to the sight line and conveys the effected measurement to an automatic steering device which derives therefrom the necessary steering commands and conveys the same to the flying body through the guiding wire. In this way, the guiding body will with a movement of deviation fly along the optical sight line which will continuously by the guiding soldier be held in the line of sight. The guiding soldier may occupy a place which is remote from the starting station.

A device for automatically transferring a started guideable weapon into the field of sight is known and described for instance in German Auslegeschrift No. 1578301.

When watching the target in conformity with the automatic guiding method, there exists the danger that the observation of the target be interfered with by a disorder or be made impossible for instance by losing the optical connection to the target because said target becomes not properly visible through an obstacle such as bushes, groups of trees, etc., and thus is lost out of the line of sight. In such an instance, when the flying body in its trajectory at the respective point or ahead of it is about to mechanically contact the obstacle, there exists the possibility of losing its guiding and crashing, or that the flying body becomes lost in view of the explosive charge of the flying body being detonated by ignition of the igniter.

It is, therefore, an object of the present invention to improve the above mentioned method and device for practicing the same so that also during a temporary loss of the target, the flying body which is automatically guided in the target direction will not be lost.

These and other objects and advantages of the invention will appear more clearly from the following specification in connection with the accompanying drawings, in which:

FIG. 1 by means of a principle sketch shows the course of a trajectory of the flying body during its approaching the target.

Figure 2:
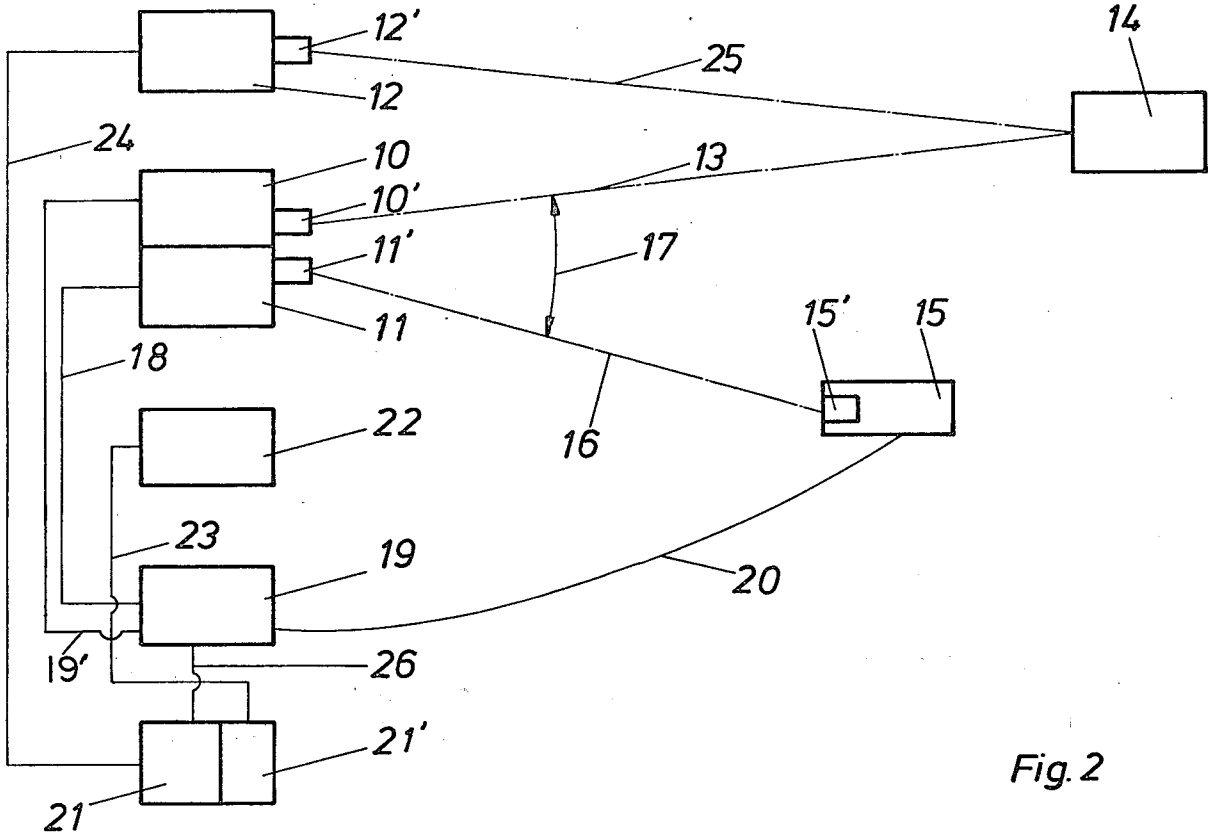

FIG. 2 shows a block diagram with an indication of the flow of the signals.

The methods according to the present invention is characterized primarily in that superimposed signals are conveyed, by an additional device with a timer, to the automatic steering installation which derives the control signals for flying bodies from sighting signals of an infrared goniometer which sighting signals are conveyed to said steering installation. The said superimposed signals are formed in the additional device from a target distance signal and a starting time signal introduced into said additional device by means of a program which is dependent on the type of the flying body and is introduced into the additional device once and for all. Said program prescribes to the flying body, in conformity with the flying time, during a first time period to perform an ascending flight at a constant ascent angle with regard to the sight line of the guiding periscope, and in a second time period to perform a descending flight toward the sight line, and in a third and last time period to perform a flight along the sight line directed toward the target.

Important in connection with this method is the longitudinal dimension of all flying time periods up to the target, especially the end approach flight phase, which means the last flight section.

The calculation is dependent upon the course of the flight speed or the passed-through flight section over the flight time and the possible steering reaction of the flight body (response to the control deviations) and the distance from the target. The values for the two first mentioned functional connections are for a certain type of flying body to be entered into the additional device. These values are known for instance from testing results.

The distance from the target differs from case to case. According to a further development of the invention, therefore, the distance from the target is entered in the said additional device manually or automatically in conformity with estimated or measured results. Thus, the additional device has all necessary information, and the prescribed time dependent influencing of the automatic steering installation can be carried out so that the flying body can be started.

However, it is to be borne in mind that the infrared goniometer can check only a sight cone with a certain opening angle about the sight line which sight cone the flying body must not leave when said flying body is not to be lost for fighting the target. In order to make sure that the flight body during its ascent flight and while considering its deviation from the rated values of its flight path will not be lost from the narrow angled field of the goniometer, the ascent angle between ascending flight path and sight line obtains a magnitude approximately equalling one quarter of the full opening angle of the sight cone of the infrared goniometer. At short and long distances from the target, depending on the flight and steering properties of the employed type of flight body, drawbacks may occur while below a certain value of the distance from the target, the two first flight time periods become short and the turning on of the ascent flight during the first flight period will no longer be possible without affecting the hitting probability, and above a certain value of the distance from the target, the height of the flight path relative to the sight line becomes too great so that there will exist a danger of contacting obstacles in the air for instance high tension wires or the like. Therefore, it is suggested that with a target distance introduced into the additional device and amounting to a distance below a certain distance, which depends on the employed type of flying body, the additional device is blocked so that the automatic steering installation cannot be affected and that with a target distance introduced into said additional device and amounting to a distance below a certain distance, which depends on the employed type of flying body and on the maximum possible sight angle of the infrared goniometer, the additional device will be programmed in such a way that with increasing target distance, the length of the first and third flying time period remains constant, and only the length of the second flight time period is changed, which means that only the descending flight path undergoes a change. It is suggested generally, which means independently of the target distance, approximately to hold constant the third and last flight time section, in order to maintain the hitting probability approximately the same.

The method according to the invention brings about the advantage that the flight of the remote control flying body will not be impeded by obstacles from the start installation to the target, especially with movable targets, and that the flying body will not be lost nor will be prematurely detonated by an obstacle.

A device for practicing the method according to the invention is characterized primarily in that the automatic guiding installation for the flying body has associated therewith an additional device with a timer and is connected to said additional device through a signal line which the target distance signal is conveyed to the additional or auxiliary device from the distance-measuring device through a signal line, and while the starting time signal is conveyed to the timer by the flying body start installation. Furthermore, the additional or auxiliary device generates the additional signals in conformity with the course of time which is conveyed to the additional device by the timer. The additional signals are conveyed to the automatic steering installation where they are superimposed upon the signals of the infrared goniometer.

Referring now to the drawing in detail, FIG. 1 illustrates a start device for a remote control reaction driven flying body together with a guiding periscope, an infrared goniometer, a distance measuring device, an automatic steering device and other equipment generally designated with the number 1. From this start device 1, a dot-dash sight line 2 leads to a target 3 which in this instance happens to be located at a higher level and is to be fought through a full line flight path or trajectory 4 by the flying body. The illustrated flight path 4 is subdivided into three time sections. During the first time section $T_1$, a flight relative to the sight line 2 is effected along the ascending flight path section 4'. During the second time section $T_2$, a flight is effected along the flight path section 4'' which drops relative to the sight line 2, and during the third and last time section $T_3$, a flight is carried out on the sight line 2 along the flight path section 4'''. Precisely taken, in all three flight time sections, the ideal flight path is illustrated from which the actual flight path will continuously deviate somewhat to a slight extent. With a closer target 3' (when with the specific example accidentally is located on the same sight line 2) corresponding flight path sections 5', 5'', 5''' of a flight path 5 and corresponding time sections $T_1'$, $T_2'$ and $T_3'$ are obtained. Preferably, for purposes of obtaining a high hitting possibility, for all target distances, the third and last time section $T_3$ and $T_3'$ are selected of the same length. With great time distances above a certain value, the flight path height 6 may become too great so that the danger of contacting obstacles in the air space, for instance high tension wires, exists.

Referring to FIG. 2, the reference numeral 10 designates a guiding periscope whereas the reference numeral 7 designates an infrared goniometer which either have a common or at least closely adjacent objective 10' and 11' respectively. Furthermore, a distance measuring device 12 is provided with an objective lens 12'. From the guiding periscope 10, there extends a sight line 13 to the target 14, whereas the infrared goniometer 11 receives the light of an infrared source 15' on the flight body 15 along a line 16 and measures an angle deviation 17 from the sight line 13 (naturally in contrast to the illustration actually as to height and side). This measured angle deviation is through a signal line 18 conveyed to an automatic steering installation 19. The automatic steering installation 19 is connected through a signal line 26 to an additional or auxiliary device 21 which comprises a timer 21'. This timer receives the starting time of the flying body from a start installation 22 of the flying body through a signal line 23, and is thus started. The programmed additional or auxiliary device 21 receives from the distance-measuring device 12 through a signal line 24 the distance from the target 14 which is measured along a sight connection 25, and generates in conformity with the time the additional signals which are necessary for the deviation of the flight path of the flying body 15 from the sight line 13 and 2 respectively. These additional signals are through the signal line 26 conveyed to the automatic steering installation 19. In the guiding installation 19, these additional signals are superimposed upon the signals of the infrared goniometer 11, are converted into the then resulting guiding commands and these guiding commands are through a guiding wire 20 conveyed to the flying body 15.

It is, of course, to be understood that the present invention, by no means, is limited to the specific showing in the drawings, but also comprises any modifications within the scope of the appended claims.

What is claimed is:

1. The method of guiding a reaction driven flying body such as a rocket having signal operable guiding means from a launching point to a target point, which comprises the steps of: determining the distance between said points, launching the body from the launching point toward the target point, detecting the instant of launching, continuously monitoring the changing instantaneous location of the body by detecting radiation emitted by the reaction driver thereof and developing predetermined flight path program guiding signals correlative to the detected instant of launching, and supplying the guiding signals to said guiding means to cause the flying body automatically to follow a flight path which diverges from a line joining said launching point and said target point during a first flying period following a launching of the flying body and which flight path approaches said line to a point of intersection during a second flying period of said body and then follows said line to the target point during a third flying period of said body.

2. The method according to claim 1 in which emitting radiation occurs from the driver for the body which body radiates in the infra red range, and wherein the detecting of the radiation step is accomplished with a goniometer whereby a cone of sight is directed toward the target.

3. The method according to claim 1 in which diverging the body diverges from said line occurs in the upward direction.

4. The method according to claim 2 in which diverging of the body occurs upwardly from said line and at an angle thereto not greater than about a quarter of the opening angle of the cone of sight of the goniometer.

5. The method according to claim 2 in which there is holding constant of said third flying period under all conditions of distance between said points.

* * * * *